United States Patent [19]

Murakami

[11] Patent Number: 4,903,352

[45] Date of Patent: Feb. 27, 1990

[54] FLUID FLOW MASSAGING APPARATUS

[75] Inventor: Eiichi Murakami, Chiba, Japan

[73] Assignees: Rally Master Co., Ltd.; All Max Co. Ltd., both of Tokyo, Japan

[21] Appl. No.: 299,375

[22] Filed: Jan. 23, 1989

[30] Foreign Application Priority Data

Feb. 5, 1988 [JP] Japan ..... 63-26303

[51] Int. Cl.[4] ..... E03C 1/02; A61H 33/02

[52] U.S. Cl. ..... 4/541; 4/544; 4/545; 4/492; 4/584

[58] Field of Search ..... 4/541–545, 4/496, 492, 493, 506, 568, 584; 128/66

[56] References Cited

U.S. PATENT DOCUMENTS

| | | | |
|---|---|---|---|
| 722,232 | 3/1903 | Hoeglauer | 4/544 |
| 1,731,554 | 10/1929 | Wheeler | 4/496 X |
| 3,420,226 | 1/1969 | Berry | 4/544 X |
| 4,339,833 | 7/1982 | Mandell | 4/542 |
| 4,364,132 | 12/1982 | Robinson | 4/661 X |
| 4,371,995 | 2/1983 | Donhauser | 4/546 X |
| 4,602,391 | 7/1986 | Shepherd | 4/492 X |

FOREIGN PATENT DOCUMENTS

| | | | |
|---|---|---|---|
| 370805 | 2/1907 | France | 4/496 |

*Primary Examiner*—Henry K. Artis

*Attorney, Agent, or Firm*—Schwartz & Weinrieb

[57] ABSTRACT

A fluid jet flow massaging apparatus adapted for use within a bathtub unit comprises a first bathtub and a second bathtub which is accommodated within the first bathtub with a space defined therebetween and which has an inner volume sufficient for accommodating a person. The second bathtub is provided with opposed side walls within which a plurality of fluid circulation holes are formed and a fluid jet circulation flow generating device is disposed within at least one hole of at least one wall of the second bathtub. The fluid jet flow caused by the device is circulated through the holes and the space defined between the first and second bathtubs and the fluid jet flow achieves the massaging operation upon the person disposed within the second bathtub as a result of the circulation of the fluid. The fluid flow direction and the fluid flow rate may be regulated by altering the number of fluid flow generating devices.

13 Claims, 2 Drawing Sheets

FLUID FLOW MASSAGING APPARATUS

FIELD OF THE INVENTION

This invention relates to a massaging apparatus, and more particularly, to a fluid flow massaging apparatus which has been adapted for use within a bathtub for exhausting jets of fluid toward a person lying within the bathtub so as to carry out the massaging operation due to the fluid jet pressure.

BACKGROUND OF THE INVENTION

Bubble generating massaging apparatus for use within a bathtub is conventionally known wherein bubbles are generated for cleaning the body of a person lying within the bathtub and for facilitating the circulation of the blood of the person due to the generation of the bubbles as seen, for example, from the Japanese Patent Laid-open Publication No. 62-41660. Within the bathtub of the type disclosed therein, the bubbles generated only act locally upon the body of the person lying within the bathtub, so that it is difficult to impart the massaging effect to substantially the entire body of the person. In order to obviate this defect of the bubble generating massaging apparatus described above, there is also known a fluid flow massaging apparatus wherein fluid such as, for example, hot water is forcibly jetted towards the person lying within the bathtub for effecting the massaging operation upon the person.

However, the known fluid flow massaging apparatus described above is generally adapted for use within a large bathtub, such as, for example, a bathtub disposed within a public bathtub house, which accommodates many persons, and accordingly, in order to generate sufficient circulation of the fluid within the bathtub, a fluid generating and circulating device which is large in size or which has a large capacity is required. In order to install such a large fluid circulation device, a complex arrangement of the duct or pipe means is required in order to obtain a fluid circulation which is sufficient so as to effectively perform the massaging operation upon the many persons simultaneously accommodated within the large bathtub. Therefore, it is difficult to utilize the fluid flow apparatus described above for a domestic home within which a relatively small bathtub is installed.

Moreover, the fluid flow massaging apparatus installed within the bathtub of the public bathtub house is disposed so as to simultaneously massage many persons lying within the bathtub, so that the fluid flow direction and the jet fluid flow rate are generally uniform throughout the bathtub, and therefore,it is difficult for the respective persons to adequately obtain effective massaging effects within a short period of time.

OBJECTS OF THE INVENTION

An object of this invention is to substantially eliminate the defects or drawbacks described hereinabove with respect to conventionally known fluid flow massaging apparatus, and to provide a fluid flow massaging apparatus having simple and compact structure which is particularly suitable for use within a bathtub of a domestic home.

Another object of this invention is to provide a fluid flow massaging apparatus which is provided with means for easily and optionally regulating the fluid flow direction and the jet filled flow rate so as to attain effective massaging effects suitable for the individual persons.

SUMMARY

These and other objects can be achieved according to this invention by providing a fluid flow apparatus comprising a first bathtub provided with four side walls and a bottom portion, a second bathtub to be accommodated within the first bathtub and having four side walls and a bottom portion, with a space defined therebetween, the second bathtub having an inner volume sufficient for accommodating a person to be massaged by the fluid jet flow, a plurality of holes formed within two opposed walls of the second bathtub and adapted to circulate the fluid therethrough, and a fluid jet flow generating device attached to the holes of at least one of the opposed walls of the second bathtub for causing the fluid to circulate between the first and second bathtubs.

According to the fluid flow massaging apparatus having the construction described above, the second bathtub within which a person is disposed is accommodated within the first bathtub with a suitable space defined therebetween and the fluid filling the first and second bathtubs is circulated by means of the fluid jet flow circulation generating device disposed within the hole or holes formed within one wall of the second bathtub through the hole or holes formed within the opposite wall thereof and the space defined between the first and second bathtubs, whereby the person lying within the second bathtub is subjected to the massaging operation by means of the fluid jet pressure and accordingly, the effective massaging effect can be achieved by means of the fluid flow massaging apparatus adapted for the bathtub with the simple and compact structure suitable for domestic use.

In the preferred embodiments of this invention, a plurality of fluid jet flow circulation generating devices may be disposed within a plurality of holes defined within the wall of the second bathtub so as to generate the fluid jet flows in different flow directions and at different flow rates so as, to generate complex turbulance fluid flows in order to achieve the effective massaging operation for the person lying within the second bathtub.

BRIEF DESCRIPTION OF THE DRAWINGS

The preferred embodiments of this invention will be described more in detail hereunder with reference to the accompanying drawings, in which like reference characters are used throughout the several views to designate like or corresponding parts, and wherein.

DESCRIPTION OF THE PREFERRED EMBODIMENT

Figure 1:
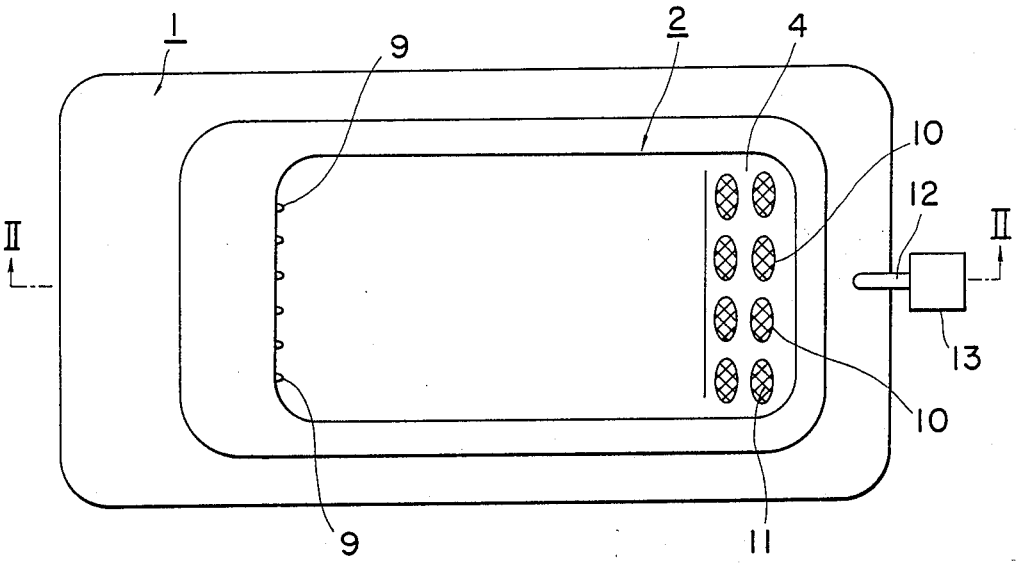
FIG. 1 is a plan view of one embodiment of a fluid flow massaging apparatus constructed according to this invention.
Figure 2:
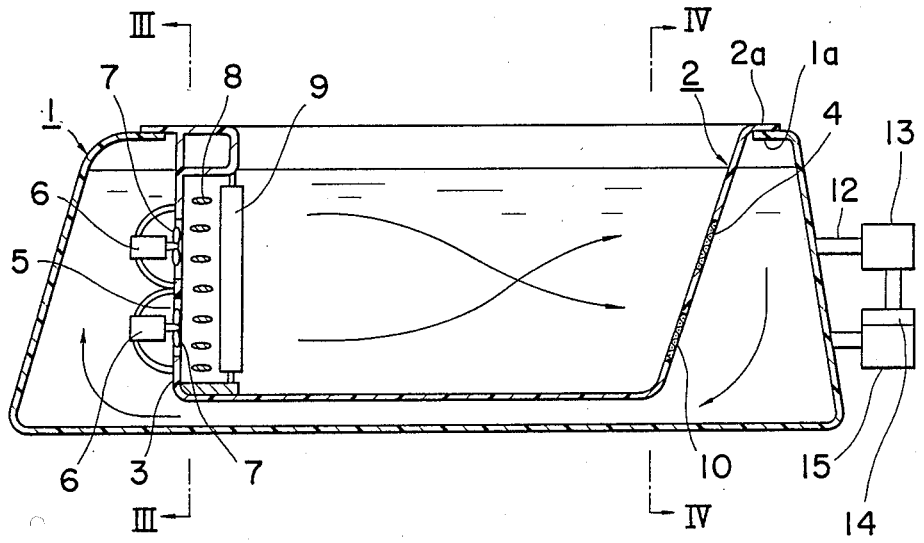
FIG. 2 is a sectional view taken along the line II—II shown in FIG. 1.

Referring to FIGS. 1 and 2, reference numeral 1 designates a first bathtub molded from a synthetic resin or similar material and adapted to be filled with fluid such as, for example, hot water, and the first bathtub 1 is provided with an opening defined by means of an upper peripheral edge 1*a* of the first bathtub 1. A second bathtub 2 is accommodated within the first bathtub 1 in such a manner that an upper peripheral edge 2*a* of the second bathtub 2 overlaps the upper surface of the outer peripheral edge 1*a* of the first bathtub 1, and the second bathtub 2 is secured in such a state so as to define a fluid circulation space between the side wall portions of the first and second bathtubs 1 and 2 and between the bottom wall portions thereof. In an alternative embodiment, not shown, the bottom portion of the second bathtub 2 is disposed upon the bottom portion of the first bathtub 1 so as to define a fluid circulation space only between the side wall portions of both the bathtubs 1 and 2. The second bathtub 2 has a substantially rectangular parallelepiped configuration having an inner space or internal volume sufficient for circulating the fluid for effecting the fluid flow massage to a person lying within the second bathtub 2. The second bathtub 2 is also provided with opposed side walls 3 and 4 within which a plurality of circular holes 5 and 10 are formed, respectively, through which fluid for massaging the person is circulated.

Figure 3:
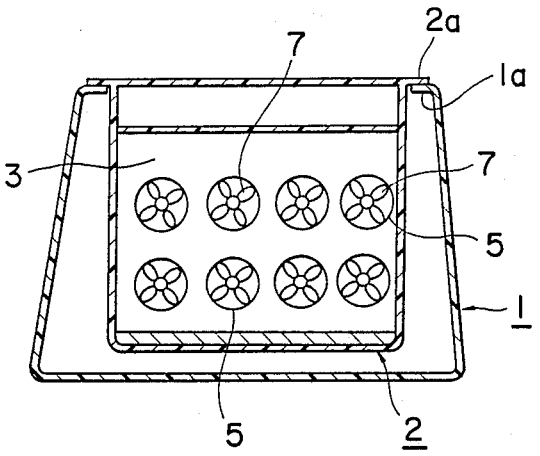
FIG. 3 is a sectional view taken along the line III—III shown in FIG. 2.
Figure 4:
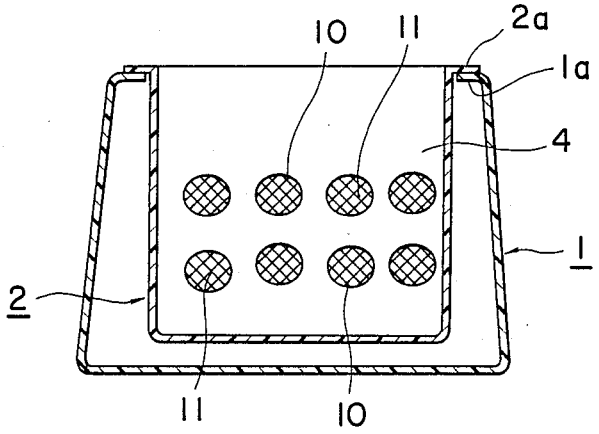
FIG. 4 is a sectional view taken along the line IV—IV shown in FIG. 2.

In the illustrated embodiment, side wall 3 of the second bathtub 2 is provided with eight circular holes 5, for example, as shown in FIG. 3, and submersible motors 6 and submersible propellers 7 each rotated by means of the corresponding submersible motor 6 are accommodated within the respective holes 5. A plurality of horizontal louver members 8 and vertical louver members 9 are located in front of the propellers 7 so as to be capable of adjusting the directions thereof in order to thereby adjust the direction of the fluid jets into the second bathtub 2. On the other hand, the side wall 4 of the second bathtub 2 is also provided with eight holes 10 as shown in FIG. 4. The second bathtub 2 is also accommodated within the first bathtub 1 so that sufficient spaces are formed between the respective side walls of the first bathtub 1 and the fluid circulation holes 5 and 10 formed within the side walls 3 and 4 of the second bathtub 2 in order to reduce the resistance to the fluid jet flow. A wire net member 11, for example, is disposed in front of each hole 10 of the wall 4 so as to prevent insertion of a hand or legs of the person lying in the bathtub 2 through the holes 10. It is desired to design the holes 5 and 10 so as to have substantially the same amount of cross sectional areas in order to achieve smooth circulation of the fluid between the first and the second bathtubs 1 and 2. In a preferred alternative embodiment, not shown, one submersible motor 6 and one propeller 7 may be substituted for the plurality of motors and propellers illustrated. Upon one of the side walls of the first bathtub 1 there is disposed a bypass pipe 12 to which a pump 13, a filter member 14, and a heating and sterilizing device 15 are operatively secured. The fluid jet massaging bathtub apparatus according to this invention and having the construction described above, will operates as follows.

After the fluid such as, for example, hot water has filled the first and second bathtubs 1 and 2 to a predetermined level, the submersible motors 6 are driven so as to rotate the propellers 7. The fluid flows rapidly within the second bathtub 2 towards the side wall 4 from the propellers 7 while the flow direction thereof is adjusted by means of the disposition or orientation of the horizontal and vertical louvers 8 and 9. The flow then passes through the circular holes 10 of side wall 4 and the circulation space defined between the first and second bathtubs 1 and 2, thus circulating throughout the composite bathtub system. This circulating fluid flow collides with a person disposed within the bathtub so as to thereby effect the massaging operation upon the person. A part of the fluid flow passes through the bypass pipe 12, is filtered by means of the filter member 14, and is sterilized by means of the sterilizing device 15 which also serves to adjust the fluid temperature.

As described above, according to the construction of this invention, the first bathtub 1 is accommodated within the second bathtub 2 so as to circulate the fluid within the second bathtub 2 within which a person is disposed, so that the entire structure of the bathtub is made compact and is therefore suitable for general domestic use.

With the embodiment described above, it is possible to drive the respective submersible motors 6 at respectively different speeds, and according to this mode, the fluid flow passes into the second bathtub 2 as turbulent flow, which changes the fluid flow direction distribution and the fluid flow rate distribution within the second bathtub 2 so as to thereby effectively achieve the massaging operation. Moreover, the fluid flow direction distribution and the fluid flow rate may also be changed over a period of time or as a function of time by changing the speeds of the respective submersible motors 6 under the control of a suitable controlling means, not shown, whereby the person within the bathtub can be subjected to the massaging operation comprising various fluid flow directions and with various fluid pressures which are changeable over a period of time. In addition, the propellers 7 may be disposed within some of the circular holes 10 of the bathtub wall 4 in addition to those of the wall 3, and therefore more complex and effective fluid flow distribution patterns with various flow rates may be attained by changing the speeds of the propellers 7 thus disposed.

It will of course be understood that the present invention is not limited to the described embodiments and various other modifications and changes may be possible within the scope of the appended claims, such as, for example, the disposition of at least two propellers 7 may be utilized for attaining the initial object of this invention in lieu of the utilization of eight propellers as described.

What is claimed is:

1. A fluid flow massaging apparatus, comprising:

a first bathtub means having four side walls and a bottom wall;

a second bathtub means disposed within said first bathtub means, having four side walls and a bottom wall, and having an inner volume sufficient to accommodate a person to be massaged by a flow of fluid;

first and second hole means defined within two oppositely facing side walls of said four side walls of said second bathtub means such that said first hole means defines a fluid inlet into said inner volume of said second bathtub means, and said second hole means defines a fluid outlet from said inner volume of said second bathtub means;

means defining a space between said first and second bathtub means for fluidically interconnecting said fluid outlet with said fluid inlet such that a fluid circuit is defined within said apparatus as including said fluid inlet, said inner volume of said second bathtub means, said fluid outlet, and said space fluidically interconnecting said fluid outlet with said fluid inlet; and means operatively mounted in association with at least one of said first and second hole means for causing said fluid to flow and circulate throughout said apparatus along said fluid circuit.

2. The massaging apparatus according to claim 1, wherein said first and second bathtub means are provided with peripheral edges for defining openings therefor, the peripheral edge of said second bathtub means being mounted on the peripheral edge of said first bathtub means so that a fluid circulation space is defined between said side walls of said first and second bathtub means and between said bottom walls thereof.

3. The massaging apparatus according to claim 1, wherein said first and second bathtub means are provided with peripheral edges for defining openings therefor, the peripheral edge of said second bathtub means being mounted on the peripheral edge of said first bathtub means so that said bottom wall of said second bathtub means is disposed on the bottom wall of said first bathtub means and a fluid circulation space is defined between said side walls of said first and second bathtub means.

4. The massaging apparatus according to claim 1, wherein said fluid circulating means comprises a submersible motor and a submersible propeller driven by said motor.

5. The massaging apparatus according to claim 1, wherein means for adjusting the fluid flow is disposed in front of said fluid circulating means.

6. The massaging apparatus according to claim 5, wherein said fluid flow adjusting means comprises a holizontal louver and a vertical louver.

7. The massaging apparatus according to claim 1, wherein said fluid circulating means comprises at least two fluid circulating units having fluid jetting capacities different from each other for causing fluid circulation flows under different jetting pressures.

8. The massaging apparatus according to claim 7 further comprises means for regulating the fluid jetting pressures of said fluid circulation units as a function of time.

9. The massaging apparatus according to claim 7, wherein said fluid circulation units are disposed in said holes of said opposing side walls of said second bathtub means.

10. Apparatus as set forth in claim 4, wherein:

said first hole means comprises eight apertures disposed in two horizontally extending rows, with four apertures defined within each row, defined within a first one of said two opositely facing side walls of said second bathtub means; and said fluid circulating means comprises a submersible motor and a submersible propeller, driven by said submersible motor, respectively disposed in association with each one of said apertures.

11. Apparatus as set forth in claim 1, wherein:

the cross-sectional area of said first and second hole means is substantially the same.

12. Apparatus as set forth in claim 1, further comprising:

pump means mounted upon said first bathtub means;

heating and sterilizing means mounted upon said first bathtub means; and filter means mounted upon said first bathtub means and interposed between said pump means and said heating and sterilizing means.

13. Apparatus as set forth in claim 4, wherein:

said second hole means comprises eight apertures disposed in two horizontally extending rows, with four apertures defined within each row, defined within a second one of said two oppositely facing side walls of said second bathtub means; and said fluid circulating means comprises a submersible motor and a submersible propeller, driven by said submersible motor, respectively disposed in association with each one of said apertures.

* * * * *